US008132750B2

(12) United States Patent
Stone et al.

(10) Patent No.: US 8,132,750 B2
(45) Date of Patent: Mar. 13, 2012

(54) FORCE MONITOR FOR PULVERIZER INTEGRAL SPRING ASSEMBLY

(75) Inventors: Richard Brian Stone, Teaneck, NY (US); Matthew Alan Munyon, Bolton, MA (US); Lawrence Scott Farris, East Granby, CT (US)

(73) Assignee: ALSTOM Technology Ltd, Baden (CH)

( * ) Notice: Subject to any disclaimer, the term of this patent is extended or adjusted under 35 U.S.C. 154(b) by 139 days.

(21) Appl. No.: 12/490,668

(22) Filed: Jun. 24, 2009

(65) Prior Publication Data

US 2010/0327094 A1 Dec. 30, 2010

(51) Int. Cl.
*B02C 15/00* (2006.01)

(52) U.S. Cl. ..... 241/121

(58) Field of Classification Search ..... 241/117–121; 267/167

See application file for complete search history.

(56) References Cited

U.S. PATENT DOCUMENTS

| | | | | |
|---|---|---|---|---|
| 7,584,917 | B2 * | 9/2009 | Briggs et al. | 241/121 |
| 2008/0237379 | A1 | 10/2008 | Briggs et al. | |

FOREIGN PATENT DOCUMENTS

| | | |
|---|---|---|
| CN | 2 155 945 | 2/1994 |
| GB | 954 872 | 8/1964 |

OTHER PUBLICATIONS

PCT International Search Report and The Written Opinion of the International Searching Authority, dated Oct. 22, 2010—(PCT/US2010/034492).

* cited by examiner

*Primary Examiner* — Mark Rosenbaum

(74) *Attorney, Agent, or Firm* — Michaud-Kinney Group LLP

(57) ABSTRACT

A pulverizer 60 includes a spring assembly 10 that urges a grinding roller 72 of a journal assembly 68 onto a grinding surface 66 of a grinding table 64. The force applied is monitored by a load cell 32 located within spring assembly 10 that creates an electronic signal. A controller 83 receives the electronic signal and stores and/or displays it and alternatively acts to adjust the applied force to a desired value. Alternatively, adjustable forces or mechanical dampening may be applied to journal assembly 68 by controller 83. Alternatively, additional sensors may measure displacement of the journal assembly and rotation of the grinding table for other calculations.

14 Claims, 2 Drawing Sheets

FORCE MONITOR FOR PULVERIZER INTEGRAL SPRING ASSEMBLY

FIELD OF THE INVENTION

The present invention generally relates to solid fuel pulverizers and is more particularly directed to the measurement of forces experienced by solid fuel pulverizers.

BACKGROUND

Solid fossil fuels such as coal often are ground in order to render the solid fossil fuel suitable for certain applications. Grinding the solid fossil fuel can be accomplished using a device referred to by those skilled in the art as a pulverizer. One type of pulverizer suited for grinding is referred to as a "bowl mill pulverizer". This type of pulverizer obtains its name by virtue of the fact that the pulverization that takes place therein is effected on a grinding surface that in configuration bears a resemblance to a bowl. In general, a bowl mill pulverizer comprises a body portion on which a grinding table is mounted for rotation. Grinding rollers mounted on suitably supported journals interact with the grinding table to effect the grinding of material interposed therebetween. After being pulverized, the particles of material are thrown outwardly by centrifugal force, whereby the particles are fed into a stream of warm and blown into other devices for separation by particle size.

Grinding rollers are urged toward the grinding table against the fossil fuel being ground by a spring assembly. The force that this exerts may be manually adjusted. The greater the force, the finer the particle size of the fossil fuels being ground.

There is no feedback relating to the amount of force being applied, or how different this force is from a desired force.

Currently, there is a need for feedback to more accurately adjust the force used to grind fossil fuels.

SUMMARY

According to aspects disclosed herein, there is provided a spring assembly for urging a grinding roller toward a grinding table with a measured force. The spring assembly has a spring housing that defines an interior area. A preload stud extends at least partially into the interior area and is coupled to the spring housing for movement relative thereto. A stop plate is positioned in the interior area with the preload stud extending through the stop plate. A spring seat is attached to, and is movable with, the preload stud. The spring seat is positioned at least partially within the interior area adjacent to an end of the spring housing. The spring seat extends at least partially through an opening defined by the spring housing. At least one spring is interposed between the spring seat and the stop plate. A load cell is positioned in the interior area of the spring housing for measuring forces exerted by the spring due to spring preload as well as movement of the spring seat relative to the spring housing.

According to another aspect disclosed herein, a pulverizer for pulverizing solid fuel includes a pulverizer housing having a shaft coupled for rotation thereto. A grinding table is mounted on the shaft and a journal assembly is pivotally mounted on the pulverizer housing. A grinding roll is coupled to the journal assembly. A spring assembly is also mounted on the pulverizer housing and includes a preload stud extending at least partially into the interior area and coupled to the spring housing for movement relative thereto. A stop plate is positioned in the interior area with the preload stud extending through the stop plate. A spring seat is attached to, and is movable with, the preload stud. The spring seat is positioned at least partially within the interior area adjacent to an end of the spring housing. The spring seat extends at least partially through an opening defined by the spring housing. At least one spring is interposed between the spring seat and the stop plate. A load cell is positioned in the interior area of the spring housing for measuring forces exerted by the spring due to movement of the spring seat relative to the spring housing. The load cell creates an electronic signal indicating the force being exerted by the spring assembly at a given time.

BRIEF DESCRIPTION OF THE DRAWINGS

Referring now to the figures, which are exemplary embodiments, and wherein like elements are numbered alike.

DETAILED DESCRIPTION

Figure 1:
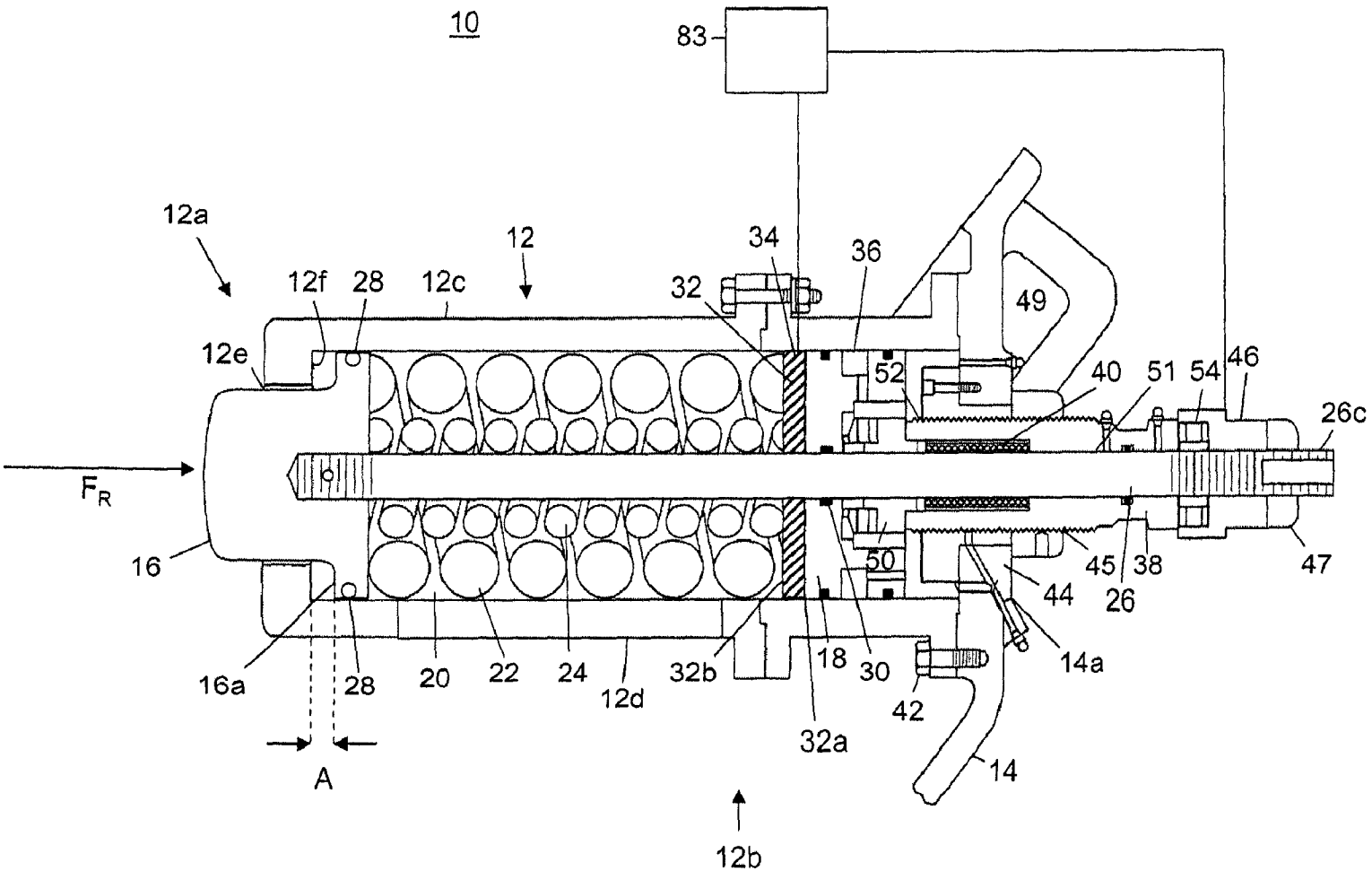
FIG. 1 is a schematic cross-sectional view of a spring assembly of the bowl mill pulverizer.

As shown in FIG. 1, a spring assembly generally designated by the reference number 10, includes a spring housing 12 having a first end 12*a* and a generally opposing second end 12*b*. The spring housing 12 also defines an interior area 13. The spring assembly 10 is mounted to a support structure 14. In the illustrated embodiment, the spring housing 12 comprises a spring cup 12*c* coupled to a cylinder 12*d*. However, the configuration of the spring assembly 10 is not limited in this regard as the housing may also have a monolithic construction without departing from the broader aspects of the present invention. A spring seat 16 is movably positioned in the interior area 13 of the spring housing 12 adjacent to the first end 12*a*. A stop plate 18 is also positioned in the interior area 13 of the spring housing 12 adjacent to the second end 12*b* thereof. A first spring 22 and a second spring 24 are positioned within the interior area 13 between the spring seat 16 and the stop plate 18. In the illustrated embodiment, the first and second springs, 22 and 24 respectively, are coil springs with one of the springs positioned within the other. However, the present invention is not limited in this regard as other coil spring configurations, or other types of springs such as, but not limited to, Belleville washers and elastomeric materials may be substituted. In addition, while a first and second spring 22, 24 have been shown and described, the present disclosure is not limited in this regard as a single spring, or more than two springs can also be employed. A preload stud 26 is threadably engaged with the spring seat 16 and extends through an aperture defined by the stop plate 18. The initial spring force can be varied by varying the position of the pressure spring seat 16 relative to the stop plate 18, by rotating the stud adjustment nut 46 relative to the preload stud 26, thus driving the preload stud 26 and spring seat 16 toward or away from the stop plate 18. Driving the preload stud 26 outward compresses the springs 22 and 24 against the stop plate 18, whereas driving the preload stud inward decompresses the springs.

Still referring to FIG. 1, the interior area of the spring housing 12 is defined by a cylindrical housing wall 27. The spring seat 16 is likewise cylindrical and is sized to be slidably positionable within the interior area 13 of the spring housing 12 when it receives a force along the direction of the arrow marked "$F_R$". The spring seat 16 may also have a circumferential groove for receiving a piston ring 28. The piston ring 28 is sealingly engageable with the spring housing 12 to minimize the likelihood of pulverized material passing therethrough.

An 'o'-ring 30 or other type of seal such as, but not limited to, a lip seal can be positioned in the aperture defined by the stop plate 18 and be at least partially and slidingly engageable with the preload stud 26 to minimize the likelihood of pulverized material passing between the stop plate 18 and the preload stud 26.

The spring assembly 10 includes a load cell 32 positioned to detect the spring forces attributable to the compression of the springs, 22 and 24 respectively, and to generate a signal indicative of the magnitude of the first and second forces. The load cell 32 may comprise, for example, a piezo electric cell that generates an electrical signal in response to an applied compressive force. However, the present invention is not limited in this regard as other types of load cells known to those skilled in the pertinent art to which the present invention pertains may be substituted. In the illustrated embodiment, the load cell 32 is positioned between the springs 22 and 24 and the stop plate 18, however, the invention is not limited in this regard, and in other embodiments a load cell may be positioned elsewhere in the spring assembly 10 where the initial, the total, and the dynamic spring forces are transmitted from the springs into the load cell.

In one embodiment, the load cell 32 is a "doughnut" type sensor, i.e., one having a circular body with flat front and rear faces 32*a*, 32*b* (disposed toward and away from the spring seat 16, respectively) and a load cell central aperture configured to allow the preload stud 26 to pass therethrough. The load sensor central aperture may also be sized to accommodate the installation of either an 'o'-ring for sealing or a wear sleeve (not shown) between the load cell 32 and the preload stud 26.

In the illustrated embodiment, the outer circumference of the load cell 32 defines a groove (unnumbered) for receiving a piston ring or 'o'-ring 34 sealingly engageable with the spring housing 12. The front and rear faces of the load cell 32 can be made from wear-resistant material, e.g., hardened steel, carbon steel, carbon steel alloy, or the like.

The load cell 32 includes an output lead 36 on the rear face 32*b*. Output lead 36 includes a power cable to supply the load cell. The output lead 36 passes through an aperture in the stop plate 18 so that the output lead 36 can be connected to controller 83. This may be, for example, signal processing equipment such as a suitably programmed general purpose computer, programmable logic controller, or the like. Controller 83 monitors the force on the first and second springs, 22 and 24 respectively. The output lead 36 may be equipped with quick-connect fittings to facilitate connection to, and removal from, the signal processing equipment and/or the load cell 32. In one embodiment, the output lead 36 is a flexible, temperature-resistant, shielded lead that resists failure due to grease and erosion caused by the high velocity pulverized air/coal stream.

The spring housing 12 is attached to the support structure 14 via bolts 42. The support structure 14 defines an aperture 14*a*. The spring housing 12 also defines an aperture 12*e* approximately coaxial with aperture 14*a*. A support bushing 44 is attached to the support structure 14 and defines a threaded bore 45 extending therethrough. A support bolt 38 defines a threaded outer surface 49 that threadably engages the threads defined by the support bushing 44.

The preload stud 26 extends from the spring seat 16 and through the stop plate 18 and the central bore 51 defined by support bolt 38, and includes a threaded portion 26*a* that extends out of the spring housing 12. A stud adjustment nut 46 threadably engages the threaded portion 26*a*. The support bolt 38 also defines a central bore 51 extending therethrough. A bushing 40 can also be positioned in the central bore 51. As seen in FIG. 1, the stud adjustment nut 46 is set on the preload stud 26 so that when the spring seat 16 is in the forward-most position (i.e., farthest from the stop plate 18, where the first and second springs, 22 and 24 respectively, at their initial degree of compression), the spring seat 16 rests at the offset A from an interior shoulder 12*f* in the spring housing 12.

The degree of initial compression of the first and second springs, 22 and 24 respectively, is determinative of the compression force exerted by the first and second springs 22 and 24 on the spring seat 16 and the stop plate 18 when the spring assembly 10 is ready for use. The initial spring force can be varied by varying the position of the pressure spring seat 16 relative to the stop plate 18, by rotating the stud adjustment nut 46 relative to the preload stud 26, thus driving the preload stud 26 and spring seat 16 toward or away from the stop plate 18. Driving the preload stud 26 outward compresses the springs 22 and 24 against the stop plate 18, whereas driving the preload stud inward decompresses the springs. An optional jam nut 47 helps keep the stud adjustment nut 46 in place on the preload stud 26 after the initial position of the preload stud in the support bolt 38 is set. The initial spring force is transmitted to the load cell 32 that in turn sends information to a controller with which the load cell is in communication. The information is indicative of the magnitude of the initial spring force.

In the illustrated embodiment, the spring assembly 10 may include a thrust bearing 50 and an optional support bolt seat 52 located between the support bolt 38 and the stop plate 18 and/or there may be a thrust bearing 54 located between the stud adjustment nut 46 and the support bolt 38. The thrust bearing 50 and the thrust bearing 54 aid in the support bolt 38 being easily turnable using a wrench. Once the support bolt 38 is set in a desired position, the position of the load cell 32 and stop plate 18 is held stationary during operation of the spring assembly 10.

The spring housing 12 has an aperture 12*e* located at the first end 12*a*, and the spring seat 16 is configured to partially protrude through the aperture. However, the spring seat 16 cannot exit the spring housing 12 through the aperture 12*e*. In one embodiment, for example, the spring seat 16 includes a flange 16*a* which is configured to slidably engage the interior shoulder 12*f* inside the spring housing 12 to prevent the spring seat 16 from passing through the aperture 12*e*.

Rotating the support bolt 38 relative to the spring housing 12, i.e., relative to the bolt bushing 44, will advance or retract the spring seat 16 in the spring housing 12. Advancing the spring seat 16 into the spring housing 12 causes the preload stud 26 and the spring seat 16 to move forward toward the first end 12*a* of the spring housing 12, and causes the spring seat 16 to protrude farther out from the aperture 12*e*. The initial compression remains constant as the support bolt 38 advances, unless the offset A between the flange 16*a* and the interior shoulder 12*f* is eliminated and the spring seat and preload stud 26 can no longer advance in the spring housing 12. Conversely, retracting the support bolt 38 from the spring housing 12 causes the stop plate 18 to move backward in the spring housing, causing the spring seat 16 to withdraw into the spring housing and to protrude less, increasing the offset A. The initial compression remains constant as the support bolt 38 retracts until the stop plate 18 engages the bolt bushing 44.

Figure 2:
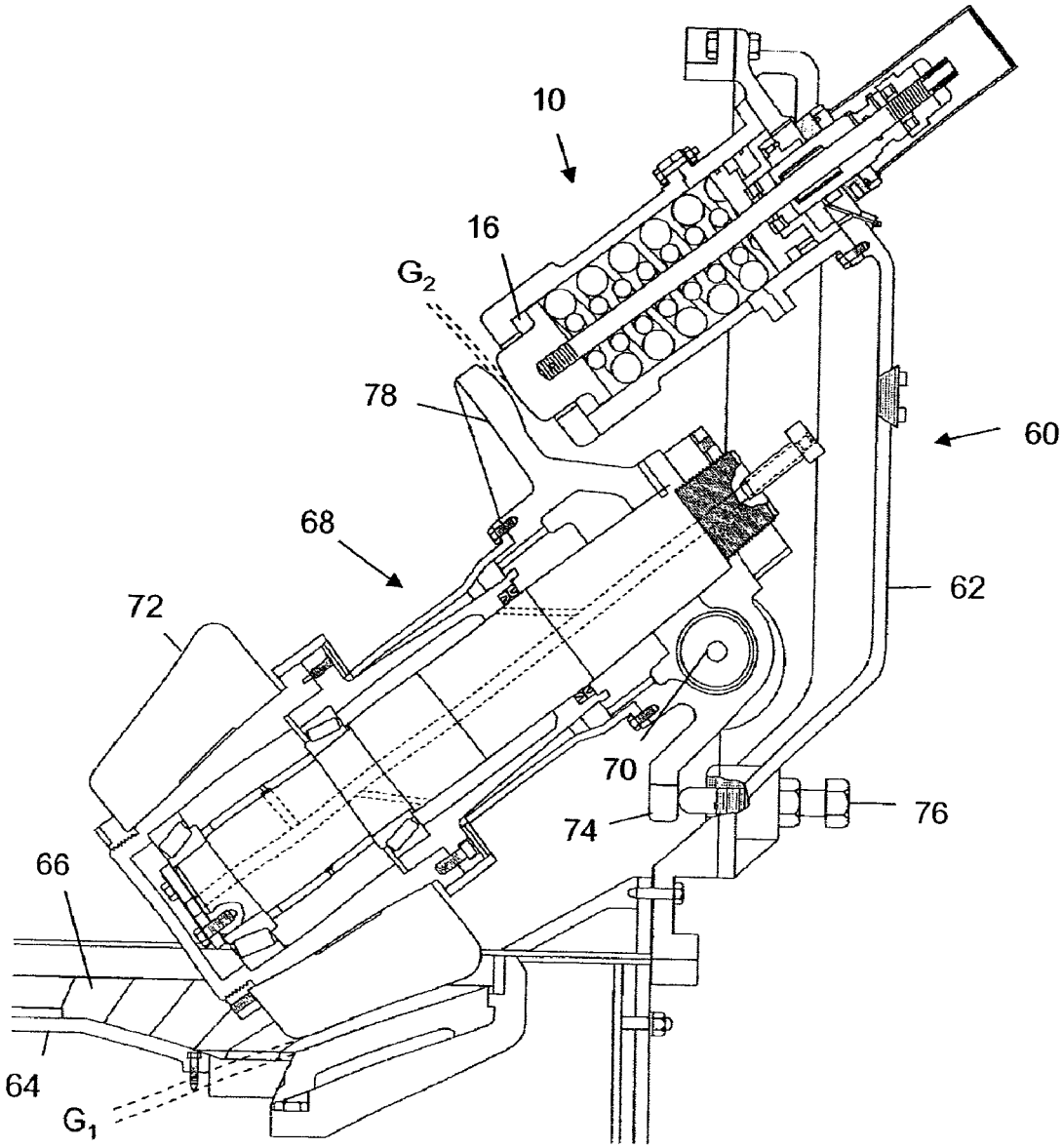
FIG. 2 is a schematic, partial, cross-sectional view of a pulverizer including the pressure spring of FIG. 1.

In an illustrative embodiment, a pulverizer 60 in FIG. 2 is a bowl mill-type pulverizer that includes a pulverizer housing 62 within which a grinding table 64 is situated to provide a grinding surface 66 for a material to be pulverized. In one embodiment, the grinding table 64 is mounted on a shaft (not shown) that in turn is operatively connected to a suitable gearbox drive mechanism (not shown) so as to be capable of being suitably driven for rotation within the pulverizer housing 62. A journal assembly 68 is pivotably mounted on a pivot shaft 70 that is secured to the pulverizer housing 62. For ease of illustration, only one journal assembly 68 and associated spring assembly 10 are shown and described, but the invention is not limited in this regard, and in other embodiments the pulverizer 60 may comprise two, three, or more journal assemblies and associated pressure spring assemblies, which may be evenly distributed about the grinding surface 66.

The journal assembly 68 carries a grinding roll 72 rotatably mounted thereon and positions the grinding roll to define a gap $G_1$ between the grinding roll and the grinding surface 66. The gap $G_1$ varies when the journal assembly 68 pivots on the pivot shaft 70. The journal assembly 68 includes a journal stop flange 74 and there is a stop bolt 76 in the pulverizer housing 62 to limit the pivoting motion of the journal assembly toward the grinding surface 66, thus setting a minimum size for the gap $G_1$. As known in the art, selecting the minimum size for the gap $G_1$ contributes to determining the particle size distribution of the pulverized material produced in the pulverizer 60.

The journal assembly 68 also includes a journal head 78, and the journal assembly and the spring assembly 10 are mounted on the pulverizer housing 62 so that the journal head can engage the spring seat 16 when the journal assembly pivots away from the grinding surface 66, e.g., in response to the introduction of granule material between the grinding surface and the grinding roll 72. Optionally, the journal assembly 68 and the spring assembly 10 may be configured so that there is a gap $G_2$ between the journal head 78 and the spring seat 16. The gap $G_2$ is at a maximum when the journal assembly pivots fully forward, i.e., when the gap $G_1$ is at a minimum. The maximum gap G2 can be adjusted by advancing or retracting the support bolt 38 as described above. When the journal assembly 68 pivots sufficiently to close the gap $G_2$, the journal head 78 engages the spring seat 16 and the spring assembly 10 imposes a spring force upon the journal head. The journal assembly 68 then conveys the spring force onto the granule material to be pulverized via the grinding roll 72. The more that the granule material causes the journal assembly 68 to pivot away from the grinding surface 66, the more the springs 22 and 24 are compressed and the greater the spring force that is imposed on the journal head 78.

In one embodiment of the use of the pulverizer 60, the material to be pulverized is coal, to provide coal powder for use as a fuel in a combustion process. Coal granules are delivered onto the grinding table 64, which is rotated so that the coal granules are crushed between the grinding surface 66 and the grinding roll 72. Larger granules of coal cause the grinding roll 72 to pivot away from the grinding surface 66 and thus engage the spring seat 16. If the coal granule is not then immediately crushed, the journal assembly 68 may then pivot further, causing the spring seat 16 to compress the springs 22 and 24. The load cell 32 generates a signal that indicates the load on the springs 22 and 24. The signal is emitted via the output lead 36. Some of the mechanical and operational factors that contribute to the journal assembly 68 movement and spring force change are the depth and location of wear on the grinding roll 72 and grinding surface 66; the roundness (circularity) of the grinding roll; the accuracy of the initial clearance set between the grinding roll and the grinding surface (the roll/ring setting procedure); the weakening of the journal spring 22, 24 caused by damage or fatigue; depth and granule size of material on the grinding table 64; and/or the size and nature of debris contained within the raw material being pulverized.

When the pulverizer 60 is in operation, the total force created in springs 22 and 24 by the spring assembly 10 as it contacts the journal assembly 68 is the sum of the initial spring force and the dynamic spring force. The dynamic spring force is the force created when the journal assembly 68 pivots upward from the grinding table 64 and compresses the springs 22 and 24 an additional amount beyond the initial degree of compression. The dynamic spring force is transmitted back onto the journal assembly 68 and onto the material to be pulverized. The value of the dynamic spring force can be about 50% to about 70% of the initial spring force, and the dynamic spring force changes with the loading of the pulverizer 60. As an example, for journal springs 22, 24 having a 25,000 pound/inch spring rate (K factor) for an initial spring compression of 1 inch, a further one-half inch compression of the springs resulting from pivoting movement of the journal assembly 68 will produce dynamic spring compression having an additional force of 12,500 pounds, for a total spring force of 37,500 pounds. In one embodiment, the initial spring force of all the spring assemblies 10 in the pulverizer 60 are kept within about 1000 pounds of each other in order to minimize bending and failure of the gearbox components. Accurate spring compression also is helpful for obtaining the desired particle size of pulverized material. For example, a desired size of coal can be selected to contribute to efficient boiler operation, boiler combustion and emissions control.

The signal from the load cell 32 is conveyed via the output lead 36 to a controller 83 (e.g., suitable data monitor and recording equipment, a programmable logic controller and/or a suitably programmed general purpose computer) that may optionally be positioned in a control room for observation and analysis by a user. The signal processing apparatus can be configured to display and record the initial spring compression force (or, "initial spring force") that is applied to each spring assembly 10 when the spring compression is set. In addition, the signal from the output lead 36 enables the user to measure, record and display the total dynamic spring force created by the spring assembly 10 as it contacts the journal assembly 68 during operation of the pulverizer 60.

In pulverizers that lack a load cell 32 it is difficult to confirm that the respective initial spring force, the dynamic spring force and total spring force that are generated during operation in the spring assembly 10 stay within a desired range of each other. The only information known about the condition of the springs 22, 24 is the initial spring force (initial spring compression) that is set on each spring assembly 10 prior to the pulverizer being placed into service. The accuracy with which the initial spring force is set is dependent on the skill of the workers and the condition of the spring compression setting equipment used. The dynamic spring force created by the spring assemblies as they contact the journal assemblies is unknown, except as the spring condition may be estimated visually by observing the vibration of the pulverizer and the movement of the preload stud 26 relative to the support bolt 38. Based on such observation, a rough assessment of the total force on the spring system and the conditions within the pulverizer is made. This is a crude, subjective and often inaccurate method and the ability to obtain useful results from using such a method is highly dependent on the experience of the personnel that make the assessment. The result is that operational problems or failure of the pulverizer, its grinding components, or its gearbox components can occur before the condition responsible for creating the problem is noticed and repaired or corrected.

The installation of a load cell 32 into each spring assembly 10 will enable the total spring force created by each spring assembly 10 during operation of the pulverizer 60 to be monitored and recorded. This data will permit the real time detection, analysis and correction of problems with the pulverizer 60 mechanical components and performance during operation. For example, the load cell 32 can be used to detect various conditions in the spring assembly 10 and/or in the pulverizer 60, such as a weak or broken spring 22 and/or 24, an incorrectly set initial compression force, an incorrectly set gap $G_1$, an out-of-round or broken grinding roll 72, a badly worn or broken grinding table 64, and/or the presence of large granules that have become trapped between the grinding surface 66 and a grinding roll 72.

The data obtained from the load cell 32 can simplify the work required to equalize the adjustment and setting of the initial spring compression force among each journal assembly 68 and spring assembly 10 in order to reduce the imbalance forces that act on the gearbox components. This, in turn, will extend the service life of the gearbox components. In addition, the data can be used to simplify and improve the accuracy of the adjustment of the pulverizer 60 to achieve a desired fineness (particle size distribution) in the material being pulverized. Attaining a desired particle size of coal facilitates proper combustion and emissions control. Plant safety can also be improved by providing real time detection and analysis of the signal from the load cell 32, which can indicate several types of mechanical and operation problems in a pulverizer 60.

A spring assembly 10 can be installed during the original manufacture of a pulverizer 60, or in a retrofit process for a prior art pulverizer, by removing a prior art spring assembly and providing a spring assembly 10 as describe herein.

In an alternative embodiment, spring assembly 10 may be an adjustable actuator controlled by controller 83. It may include a motor that may screw stud adjustment nut 46 inward or outward increasing or decreasing spring force under the control of controller 83. Controller 83 may sense the signal from the load cell 32, calculate a desired amount of force to be supplied by spring assembly 10, then cause spring assembly 10 to adjustably apply the desired amount of force.

In still another alternative embodiment, the spring assembly 10 may be replaced with hydraulic or pneumatic actuators operating under the control of controller 83.

In another embodiment, a mechanical dampening device 81, such as a conventional shock absorber, may be attached between pulverizer housing 62 and journal assembly 68 to dampen the motion of journal assembly 68 relative to pulverizer housing 62. This dampening device 81 may also exhibit variable dampening force that is controlled by controller 83.

The terms "first," "second," and the like, herein do not denote any order, quantity, or importance, but rather are used to distinguish one element from another. The terms "a" and "an" herein do not denote a limitation of quantity, but rather denote the presence of at least one of the referenced item.

While the invention has been described with reference to various exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A pulverizer for pulverizing a solid fuel, the pulverizer comprising:

a pulverizer housing having a shaft coupled for rotation therein;

a grinding table rotatably mounted on the shaft;

a journal assembly pivotally mounted on the pulverizer housing;

a grinding roller coupled to the journal assembly;

a spring assembly is mounted on the pulverizer housing, the spring assembly having a spring and a stop plate, the at least one spring urging the grinding roller toward the grinding table; and a load cell between the spring and the stop plate of the spring assembly adapted to measure spring forces exerted by the spring assembly and create an electronic signal corresponding to the measured spring forces.

2. The pulverizer of claim 1, further comprising a controller that receives and processes the electronic signal from load cell.

3. The pulverizer of claim 2, further comprising a dampening device responsive to the controller for applying an amount of mechanical dampening indicated by the controller to the grinding roller.

4. The pulverizer of claim 1, further comprising a controller that receives and stores the electronic signal from load cell.

5. The pulverizer of claim 1, further comprising a controller which receives the electronic signal from the load cell indicating measured spring forces and adjusts the spring force applied by spring assembly to provide a spring force indicated by controller.

6. The pulverizer of claim 1, further comprising a dampening device for applying a predetermined amount of mechanical dampening to the grinding roller.

7. The pulverizer of claim 1, wherein the spring assembly further comprises:

a spring housing having a first end and a second end, the spring housing defining an interior area;

a preload stud extending at least partially into the interior area, the preload stud being coupled to the spring housing for movement relative thereto;

wherein the preload stud extends through the stop plate;

a spring seat attached to and movable with the preload stud, the spring seat being located at least partially in the interior area and adjacent to an end of the spring housing;

the spring seat partially extending through an opening defined by the spring housing; and wherein the spring is at least one spring interposed between the spring seat and the stop plate.

8. The spring assembly of claim 7 further comprising:

a support bolt threadably coupled to the spring housing and movable relative thereto, and wherein movement of the support bolt causes movement of the stop plate and thereby compression of the at least one spring.

9. The spring assembly of claim 8 wherein the preload stud extends through the support bolt, and wherein the spring assembly further comprises a stud adjustment nut threadably engaged with an end of the preload stud opposite the spring seat, the stud adjustment nut being cooperable with the support bolt so that rotation of the stud adjustment nut sets the amount by which the spring seat protrudes out of the spring housing and increases or decreases the compression of the at least one spring.

10. The spring assembly of claim 7, wherein the load cell is configured to generate data indicative of the load exerted by the at least one spring, the data being receivable by a controller in communication with the load cell.

11. A spring assembly comprising:

a spring housing having a first end and a second end, the spring housing defining an interior area;

a preload stud extending at least partially into the interior area, the preload stud being coupled to the spring housing for movement relative thereto;

a stop plate positioned in the interior area, the preload stud extending through the stop plate;

a spring seat attached to and movable with the preload stud, the spring seat being located at least partially in the interior area and adjacent to an end of the spring housing;

the spring seat partially extending through an opening defined by the spring housing;

at least one spring interposed between the spring seat and the stop plate; and a load cell positioned in the interior area of the spring housing between the spring and the stop plate adapted to measure spring forces exerted by the spring due to movement of the spring seat relative to the spring housing.

12. The spring assembly of claim 11 comprising an support bolt threadably coupled to the spring housing and movable relative thereto, and wherein movement of the support bolt causes movement of the stop plate and thereby compression of the at least one spring.

13. The spring assembly of claim 12 wherein the preload stud extends through the support bolt, and wherein the spring assembly further comprises a stud adjustment nut threadably engaged with an end of the preload stud opposite the spring seat, the stud adjustment nut being cooperable with the support bolt so that rotation of the stud adjustment nut sets the amount by which the spring seat protrudes out of the spring housing and increases or decreases the compression of the at least one spring.

14. The spring assembly of claim 11, wherein the load cell is configured to generate data indicative of the load exerted by the at least one spring, the data being receivable by a controller in communication with the load cell.

* * * * *